US008982677B2

(12) United States Patent
Graf et al.

(10) Patent No.: US 8,982,677 B2
(45) Date of Patent: Mar. 17, 2015

(54) CHANGE OF STATE INDICATOR FOR A JUMP DISPLAY MECHANISM

(71) Applicant: Blancpain SA, Le Brassus (CH)

(72) Inventors: Sebastien Graf, Le Mont-sur-Lausanne (CH); Vincent Beccia, Pully (CH)

(73) Assignee: Blancpain SA, Le Brassus (CH)

( * ) Notice: Subject to any disclaimer, the term of this patent is extended or adjusted under 35 U.S.C. 154(b) by 156 days.

(21) Appl. No.: 13/678,119

(22) Filed: Nov. 15, 2012

(65) Prior Publication Data

US 2013/0128706 A1 May 23, 2013

(30) Foreign Application Priority Data

Nov. 17, 2011 (CH) ..... 11189553.8

(51) Int. Cl.

| | |
|---|---|
| ***G04B 19/253*** | (2006.01) |
| ***G04B 45/00*** | (2006.01) |
| ***G04B 19/02*** | (2006.01) |
| ***G04B 19/04*** | (2006.01) |

(52) U.S. Cl.

CPC ..... *G04B 19/25353* (2013.01); *G04B 45/0007* (2013.01); *G04B 19/02* (2013.01); *G04B 19/04* (2013.01)

USPC ..... 368/223; 368/228; 368/38; 368/77

(58) Field of Classification Search

CPC ..... G04B 19/202; G04B 19/24; G04B 19/25373; G04B 19/25353

USPC ..... 368/37, 38, 77, 221, 228, 232, 233

See application file for complete search history.

(56) References Cited

U.S. PATENT DOCUMENTS 2,051,611 A * 8/1936 Liner ..... 368/77
3,240,006 A * 3/1966 Reese ..... 368/38

(Continued)

FOREIGN PATENT DOCUMENTS

CH 133500 A 6/1929
CH 321182 A 4/1957
CH 691 833 A5 10/2001

OTHER PUBLICATIONS

English Translation of CH 691,833, Electronic Translation retrieved Jun. 3, 2014.*

(Continued)

*Primary Examiner* — Amy Cohen Johnson
*Assistant Examiner* — Matthew Powell
(74) *Attorney, Agent, or Firm* — Sughrue Mion, PLLC

(57) ABSTRACT

A change of state indicator (2) device for a timepiece display mechanism (30) by jumps of a given magnitude for the display of a transition between two stable display states of this given magnitude movable close to the display zone of this magnitude facing a supplementary display (3) driven discontinuously by a drive element (7) against elastic return means (19). A driving pinion (9) controls a star wheel (10) in a discontinuous manner to control each jump against a beak (14) of a first arm (15) of a lever (13) controlling a pivoting movement and a return to position of this indicator (2) each time this beak (14) passes between two successive tooth spaces (12) of this star wheel (10) by means of a tooth (11) between these spaces (12). The lever (13) includes a second support arm (16) for supporting the indicator (2) or controlling its displacement.

21 Claims, 2 Drawing Sheets

(56) References Cited

U.S. PATENT DOCUMENTS

| | | | | |
|---|---|---|---|---|
| 3,533,228 | A * | 10/1970 | Hurt | 368/221 |
| RE27,278 | E | 1/1972 | Brasher | |
| 5,134,595 | A * | 7/1992 | Faber et al. | 368/77 |
| 6,295,250 | B1 * | 9/2001 | Ray et al. | 368/37 |
| 2009/0129207 | A1 * | 5/2009 | Watanabe | 368/37 |
| 2010/0135125 | A1 * | 6/2010 | Watanabe | 368/37 |

OTHER PUBLICATIONS

"Digital, die neue Art, die Zeit zu lesen", DIE UHR, Nov. 10, 1972, p. 74, vol. 27, No. 21.

European Search Report for EP 11 18 9553, dated Jul. 31, 2012.

* cited by examiner

CHANGE OF STATE INDICATOR FOR A JUMP DISPLAY MECHANISM

This application claims priority from European Patent Application No. 11189553.8 filed Nov. 17, 2011, the entire disclosure of which is incorporated herein by reference.

FIELD OF THE INVENTION

The invention relates to a mechanical change of state indicator device for a semi-instantaneous or instantaneous display mechanism by jumps of a given magnitude driven by a drive element of a movement or a timepiece, wherein for the display of a transition between two stable states of display of said given magnitude said device comprises a change of state display indicator, which is movable close to the display zone of said given magnitude in relation to a supplementary change of state display, and wherein said indicator is driven indirectly and discontinuously by said drive element against elastic return means that said device comprises.

The invention also relates to a semi-instantaneous or instantaneous display mechanism by jumps of a given magnitude driven by a drive element of a movement or a timepiece comprising such a mechanical change of state indicator device.

The invention also relates to a clock movement comprising such a semi-instantaneous or instantaneous display mechanism by jumps of a given magnitude or comprising such as mechanical change of state indicator device.

The invention also relates to a timepiece comprising such a movement or such a semi-instantaneous or instantaneous display mechanism by jumps of a given magnitude or comprising such as mechanical change of state indicator device.

The invention relates to the field of timepieces and scientific equipment, and more specifically such that are equipped with semi-instantaneous or instantaneous jump display mechanisms.

BACKGROUND OF THE INVENTION

Semi-instantaneous or instantaneous jump display mechanisms for timepieces or scientific equipment are designed to display at least one value of a first magnitude in an aperture.

This value is discrete and changes upon a, generally periodic, jump controlled by a mechanism or by a signal.

The display of such a magnitude is often supplemented by displays of other magnitudes, either likewise by jumps or by other means, such as e.g. the positioning of hands facing a dial plate. Thus, document CH 691 833 A5 VACHERON & CONSTANTIN SA describes a display module with jump hours display and a retrograde minutes display, the mechanism of which is driven by the cannon pinion. This jump hours display comprises an aperture, through which a number carried by an hour disc is visible, and the retrograde minutes display comprises a hand that is out of centre in relation to the display module, wherein this hand cooperates with an arc-shaped graduation with an angular extent of less than 180°.

In general, when the period of the first magnitude is large in relation to those pertaining to other displays, the user knows to estimate the exact value of the first magnitude when the other displays allow him/her to observe that the moment of the jump is sufficiently distant to avoid any ambiguity. For example, if the first magnitude is the hour and another display magnitude is the minute, the user sees, depending on the position of the minute indicator, where one is in relation to the instant of the hour change jump, provided, however, that the minute indicator displays that the instant of this jump is sufficiently far away: for example, the user determines without effort a time of 11 hours 5 minutes or even a time of 11 hours 45 minutes. The situation becomes more tricky as the moment of the jump approaches, since the user does not have the means to know whether the jump is going to occur or if it has just occurred, above all if he/she has not looked at the display in the preceding instants. For example, if the user sees a display of a value 12 for the hour and a value 0 for the minutes, he/she cannot know if the real time is midday (in which case the jump has just occurred) or 12 hours 59 minutes (just before the 1 pm jump). There is no simple solution allowing the user to determine instantaneously if the jump has already taken place or is in progress.

SUMMARY OF THE INVENTION

The invention proposes giving the user assurance when consulting the display of a semi-instantaneous or instantaneous jump display mechanism to enable him/her to determine instantaneously whether the jump has already taken place or is in progress.

In particular, the invention proposes an appropriate solution in the case of a jump hour timepiece.

On this basis, the invention relates to a mechanical change of state indicator device for a semi-instantaneous or instantaneous display mechanism by jumps of a given magnitude driven by a drive element of a movement or a timepiece, wherein for the display of a transition between two stable states of display of said given magnitude said device comprises a change of state display indicator, which is movable close to the display zone of said given magnitude in relation to a supplementary change of state display, and wherein said indicator is driven indirectly and discontinuously by said drive element against elastic return means that said device comprises, wherein said device comprises a driving pinion fitted to be driven directly or indirectly by a said drive element, wherein said driving pinion drives a star wheel in a discontinuous manner in order to control a pivoting movement of said star wheel to control each jump of said semi-instantaneous or instantaneous display mechanism against a jumper applied against said star wheel by said elastic return means and said jumper is formed by a beak of a lever controlling a pivoting movement and a return to position of said indicator each time said beak passes between two successive tooth spaces that said star wheel comprises by means of a tooth located between said spaces, said lever comprising a first support arm of said beak and a second support arm of said indicator or controlling the displacement of said indicator.

According to a characteristic of the invention, said lever consists of a single piece, pivots around a pivot axis and is returned to a stable position of equilibrium corresponding to the stoppage of said beak in one of said tooth spaces and supported by two of said successive teeth of said star wheel by the action of said elastic return means formed by at least one spring, and in that said lever is moved away from said stable position of equilibrium by the effect of the pivoting movement of said star wheel around a star pivot axis by the action of said driving pinion driven by said drive element.

According to another characteristic of the invention, said lever is articulated and a first support arm of said beak is returned to a stable position of equilibrium corresponding to the stoppage of said beak in one of said tooth spaces and said beak supported by two of said successive teeth of said star wheel by the action of said elastic return means formed by at least one spring, and in that said lever is moved away from said stable position of equilibrium by the effect of the pivoting movement of said star wheel by the action of said driving pinion driven by said drive element, wherein the pivoting movement of said first arm drives that of a second arm integral thereto, which is itself articulated to a third pivoting support arm of said flag.

According to another characteristic of the invention, said second arm of said lever comprises a rack arranged to pivot a support pinion of said indicator in an interdependent manner.

According to another characteristic of the invention, said indicator comprises a change of state display flag, which is movable in relation to said supplementary change of state display formed by a change of state aperture, and said flag comprises a first sector indicating a transition in progress and a second sector indicating a stable state of the display without transition in progress.

According to another characteristic, said device is a change of state indicator for a semi-instantaneous or instantaneous jump hours display mechanism driven by a drive element formed by the cannon pinion of a timepiece movement, and said device comprises a driving pinion mounted to pivot interdependently with a minute wheel engaging with said cannon pinion to discontinuously drive a star wheel in order to control a pivoting movement of said star wheel and a jump of said star wheel by the action of a jumper applied against said star wheel by said elastic return means and activating each jump of the hours of said semi-instantaneous or instantaneous display mechanism.

The invention also relates to a semi-instantaneous or instantaneous display mechanism by jumps of a given magnitude driven by a drive element of a movement or a timepiece comprising such a mechanical change of state indicator device, characterised in that said change of state indicator device performs a jump according to a reciprocating pivoting movement of said indicator for each jump of said semi-instantaneous or instantaneous display mechanism.

According to a characteristic of the invention, said semi-instantaneous or instantaneous jump display mechanism is a semi-instantaneous or instantaneous jump hours display mechanism and incorporates such a device.

The invention also relates to a timepiece movement comprising such a semi-instantaneous or instantaneous display mechanism by jumps of a given magnitude driven or comprising such a change of state indicator device, characterised in that it comprises a drive element for driving said change of state indicator device.

The invention also relates to a timepiece comprising such a movement or such a semi-instantaneous or instantaneous display mechanism by jumps of a given magnitude driven or comprising such a change of state indicator device, characterised in that it comprises a drive element for driving said change of state indicator device.

BRIEF DESCRIPTION OF THE DRAWINGS

Other characteristics and advantages of the invention will become clearer from reading the following detailed description with reference to the attached drawings, wherein.

DETAILED DESCRIPTION OF PREFERRED EMBODIMENTS

Figure 5:
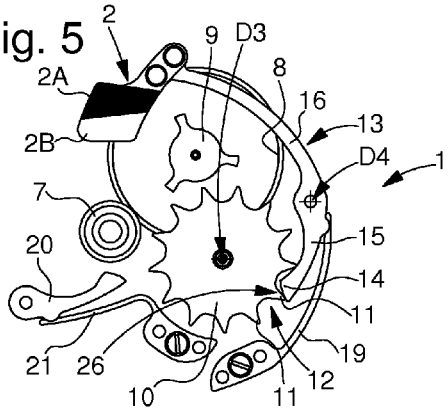
FIG. 5 is a schematic partial front view of this flag fixed to the end of a second arm of a lever, which is returned by a spring and a first arm of which cooperates in the resting position with a star wheel, which is driven indirectly from the cannon pinion through a star driving pinion, and corresponds to the display of FIG. 1.

The invention relates to the field of timepieces or scientific equipment, and more specifically to such fitted with semi-instantaneous or instantaneous jump display mechanisms.

More specifically, the invention is described here in a non-restrictive application of the invention to a watch equipped with a jump hour device. A person skilled in the art will transpose the content thereof to similar mechanisms without difficulty.

The invention relates to a mechanical change of state indicator device 1 for a semi-instantaneous or instantaneous display mechanism 30 by jumps of a given magnitude driven by a drive element 7 of a movement 60 or a timepiece 1000.

The purpose of this device 1 is to perform the display of a transition between two stable states of display of this given magnitude before and after a jump. The display causes the user to be able to see an indicator for the absence of a jump, a jump in progress and a jump performed, this returning to the first case of the absence of a jump.

On this basis, for the display of a transition between two stable states of display of said given magnitude, the device 1 comprises a change of state display indicator 2, which is movable close to the display zone of this given magnitude in relation to a supplementary change of state display means 3. The indicator 2 is driven indirectly and discontinuously by the drive element 7 against elastic return means 19 that the device 1 comprises.

According to the invention the device 1 comprises a driving pinion 9 fitted to be driven directly or indirectly by such a drive element 7. This driving pinion 9 drives a star wheel 10 in a discontinuous manner in order to control a pivoting movement of this star wheel 10 to control each jump of the semi-instantaneous or instantaneous display mechanism 30 against a jumper 26 applied against this star wheel 10 by these elastic return means 19.

The jumper 26 is preferably formed by a beak 14 of a lever 13 controlling a pivoting movement and a return to position of the indicator 2 each time the beak 14 passes between two successive tooth spaces 12 that the star wheel 10 comprises by means of a tooth 11 located between these spaces 12. The lever 13 preferably comprises a first support arm 15 of the beak 14 and a second support arm 16 of the indicator 12 or controlling the displacement of this indicator 2, for example, by means of an articulated mechanism, as can be seen in FIG. 9 or 10.

In a first embodiment evident from FIGS. 1 to 8, the lever 13 consists of a single piece, pivots around a pivot axis D4 and is returned to a stable position of equilibrium corresponding to the stoppage of the beak 14 in a tooth space 12 and said beak supported by two successive teeth 11 of star wheel 10, by the action of said elastic return means 19. These are preferably formed by at least one spring.

The lever 13 is moved away from its stable position of equilibrium by the effect of the pivoting movement of the star wheel 10 around a star pivot axis D3 by the action of the driving pinion 9 driven by the drive element 7.

Figure 9:
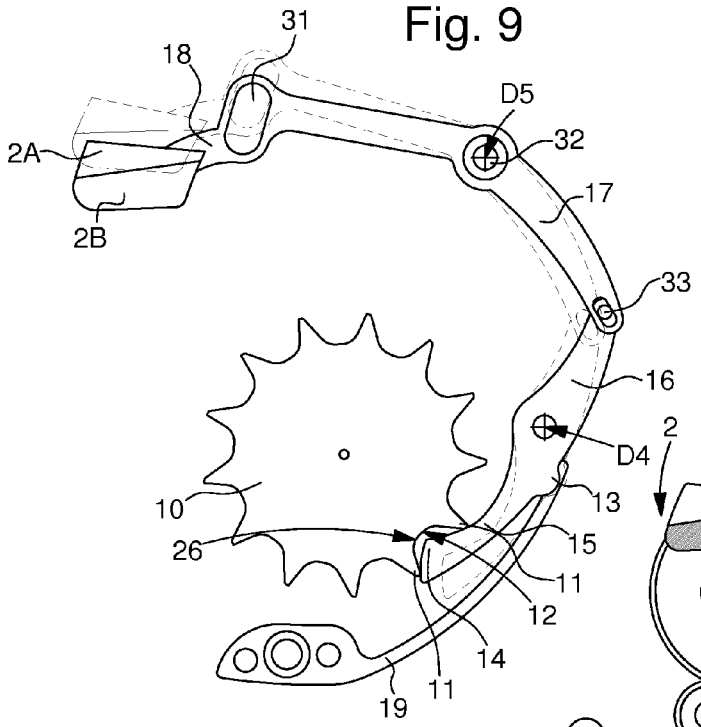
FIG. 9 shows a detail of the mechanism in a second embodiment of the invention, in which the first arm of the flag-carrier lever is articulated.
Figure 10:
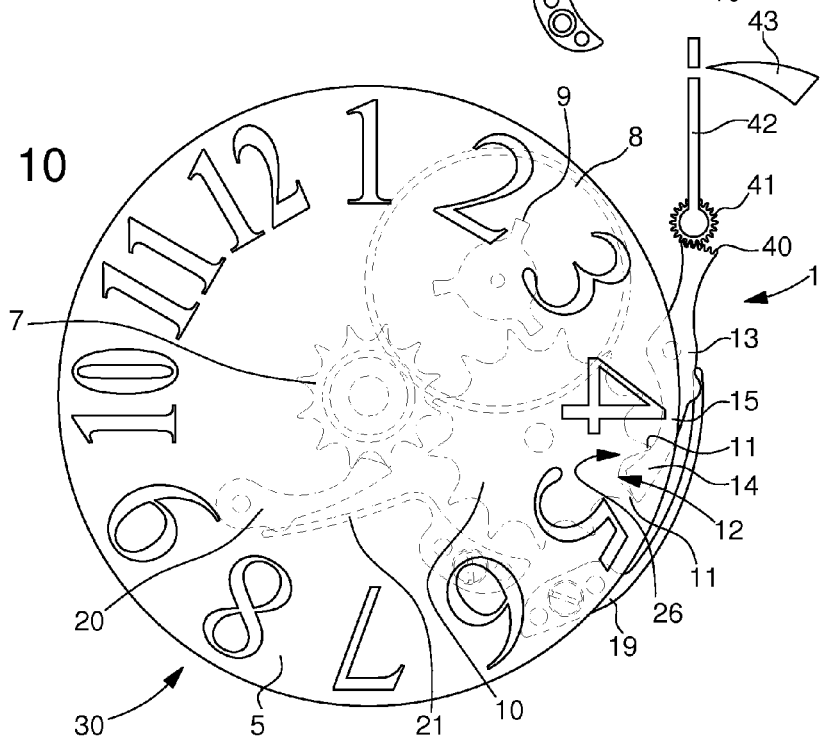
FIG. 10 shows a third embodiment of the invention in a similar manner to FIG. 5.

In a second embodiment evident from FIG. 9, the lever 13 is articulated and, in a similar manner, a first support arm 15 of the beak 14 is returned to a stable position of equilibrium corresponding to the stoppage of this beak 14 in a tooth space 12 and supported by two successive teeth 11 of the star wheel 10 by the action of the elastic return means 19. The lever 13 is moved away from its stable position of equilibrium by the effect of the pivoting movement of the star wheel 10 by the action of the driving pinion 9 driven by the drive element 7. The pivoting movement of the first arm 15 drives that of a second arm 16 that is integral thereto, and which is itself articulated to a third pivoting support arm 17, the carrier of the indicator 2 or a flag forming this indicator 2.

In a third embodiment evident from FIG. 10, the second arm of the lever 13 comprises a rack 40 arranged to pivot a support pinion 41 of the indicator 2 in an interdependent manner. In the example illustrated by the figure, this indicator 2 has a hand 42 or also a disc or similar, which is movable in relation to the supplementary change of state display 3 that is formed by a guide mark 43, e.g. placed on the dial plate, or similar. This guide mark 43 enables the stable state to be distinguished from the state preceding the jump. Thus, it is the position of the indicator 2 that provides the user with a visual indication of the imminence of a jump or of the accomplishment of this jump. The combination of these movements of the rack 40 and the pinion 41 impress a reciprocating movement on the hand 42 facing the guide mark 43.

It is understood that this arrangement allows the positioning of the change of state indicator 1 to be easily displaced to take advantage of a vacant zone of the dial plate. For example, when the display of the hour is performed on a small dial plate centred at 6 o'clock on a large dial plate that the timepiece comprises and only occupies a lesser portion of this large dial plate, the indicator 1 can advantageously be displaced in the upper area of the dial plate.

In an advantageous embodiment, the device 1 is a change of state indicator 1 for a semi-instantaneous or instantaneous jump hours display mechanism 30 driven by a drive element 7 formed by the cannon pinion of a timepiece movement 100. The device 1 comprises such a driving pinion 9 mounted to pivot interdependently with a minute wheel 8 engaging with the cannon pinion 7 to discontinuously drive a star wheel 10 in order to control a pivoting movement of the star wheel 10 and a jump of this star wheel 10 by the action of a jumper 26. This jumper 26 is applied against the star wheel 10 by the elastic return means 19 and activates each jump of the hours of the semi-instantaneous or instantaneous display mechanism 30.

In this embodiment, by means of the driving pinion 9 and the star wheel 10 during the jump of the latter, the cannon pinion 7 periodically drives an hour star wheel 22 held by a jumper 20 restored by a spring 21: this hour star wheel 22 drives a hour disc 5, which has as many flag apertures 6 as there are hours display positions, and each flag aperture 6 is arranged comes into superposed position with the supplementary change of state display 3, formed here by a change of state aperture 3, to allow the display of the indicator 2, formed here by a flag 2.

Figure 3:
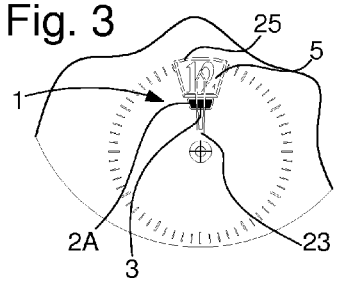
FIG. 3 shows the same mechanism at 13 hours 0 minutes; the aperture is completely filled by the second dark coloured section of the flag, which indicates that the jump of the hours display has not yet occurred.

The minutes display occurs here on a small dial plate located at 6 o'clock of the large dial plate that the timepiece 1000 comprises by means of a hand 23, which is advantageously hollowed to allow the contents of the apertures 25 and 3 to be read when this hand 23 is located at 12 o'clock on the small dial plate, as illustrated in FIG. 3.

In another variant that is not illustrated in the figures, the device 1 is a change of state indicator 1 for a semi-instantaneous or instantaneous jump display mechanism 30 for days of the month driven by a drive element 7 formed by the cannon pinion of a timepiece movement 100. As above, this device 1 comprises a driving pinion 9 mounted to pivot interdependently with a day wheel engaging directly or indirectly with the cannon pinion 7 to discontinuously drive a star wheel 10 in order to control a pivoting movement of this star wheel 10 and a jump of the star wheel 10 by the action of a jumper 26 applied against this star wheel 10 by the elastic return means 19 and activating each jump of the days of the semi-instantaneous or instantaneous display mechanism 30. By means of the driving pinion 9 and the star wheel 10 during the jump of the latter, the cannon pinion 7 periodically drives a day star wheel held by a jumper restored by a spring and driving a day disc 60, which has as many flag apertures 6 as there are hours display positions, and each flag aperture 6 being arranged to come into superposed position with the supplementary change of state display 3, formed here by a change of state aperture 3 to allow the display of the indicator 2.

In the first embodiment of the invention illustrated in FIGS. 1 to 8, the indicator 2 comprises a flag 2. In the non-limitating version illustrated by the figures, this flag 2 comprises a first sector 2A indicating a transition in progress and a second sector 2B indicating a stable state of display without transition in progress. In this first embodiment the supplementary change of state display means 3 is also formed by a change of state aperture 3.

FIG. 5 shows the indicator flag 2 fixed on an indicator blade 18 at the end of a second arm 16 of a lever 13. A first arm 15 of this lever 13 cooperates in resting position with a star wheel 10, which is driven indirectly from the cannon pinion 7, which here forms the drive element, through a driving pinion of the star wheel 9.

The lever 13 is biaised by a spring 19.

Figure 6:
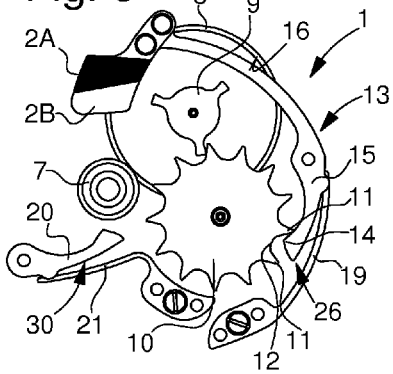
FIG. 6 is similar to FIG. 5 and corresponds to the display of FIG. 2: a jump is about to occur and the second arm of the lever is pushed back to mid-way between the space and the end of a tooth of the star wheel.
Figure 7:
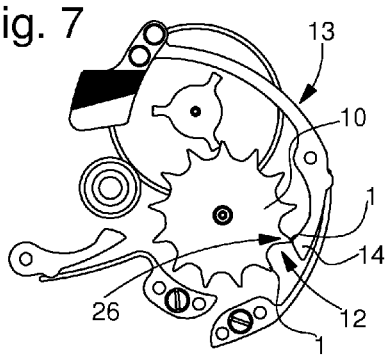
FIG. 7 is a view similar to FIG. 6, but corresponding to FIG. 3: a jump is imminent and the second arm of the lever is pushed back to the end of a tooth of the star wheel.

As can be seen in FIGS. 6 and 7, the lever 13 controls the flag 2, which in a first embodiment of FIGS. 5 to 8 is integral with one of its ends at the level of the second arm 16 of the lever 13 to respectively arrange the following to face the change of state aperture 3:

at least partially the first sector 2A indicating a transition in progress when the beak 14 is supported by a single tooth 11 of the star wheel 10, only the second sector 2B indicating a stable state of the display each time said beak 14 is stopped in a tooth space 12 and supported by two successive teeth 11 of said star wheel 10.

Figure 2:
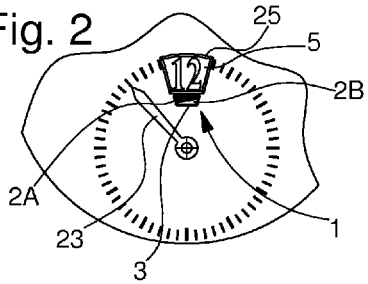
FIG. 2 shows the same mechanism at 12 hours 53 minutes; a jump of the hours display is about to occur, as indicated by the flag, which through the aperture shows a first section in a light colour and a second section in a dark colour.

FIGS. 2 and 3 illustrate the first case: in FIG. 2 both a part of the first sector 2A and of the second sector 2B can be seen in the aperture 3 and in FIG. 3, which corresponds to the point of disequilibrium immediately preceding the jump, only the first sector 2A can be seen.

Figure 1:
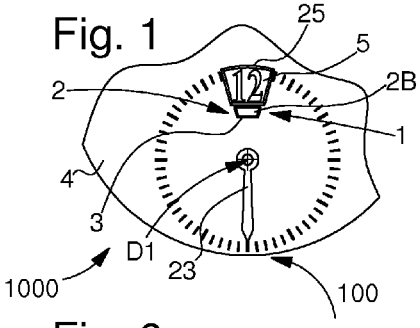
FIG. 1 is a schematic front view of a timepiece equipped with a mechanical change of state indicator device according to the invention in a first embodiment for a semi-instantaneous or instantaneous jump display mechanism, in a particular application for the display of jump hours; the timepiece is shown as visible at 12 hours 30 minutes, wherein the number of hours appears in a window aperture and the display of the minutes is achieved by a hand facing a dial plate; a specific aperture located below the hours window allows a flag to briefly be seen, which at the moment in question is uniformly visible in a first light colour.
Figure 4:
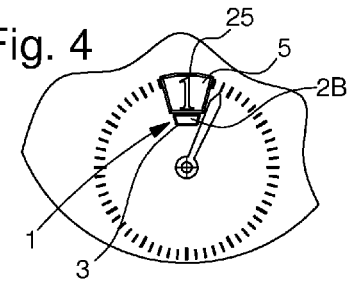
FIG. 4 shows the same mechanism at 13 hours 4 minutes; the aperture is completely filled by the first light coloured section of the flag, which indicates that the jump of the hours display has occurred.
Figure 8:
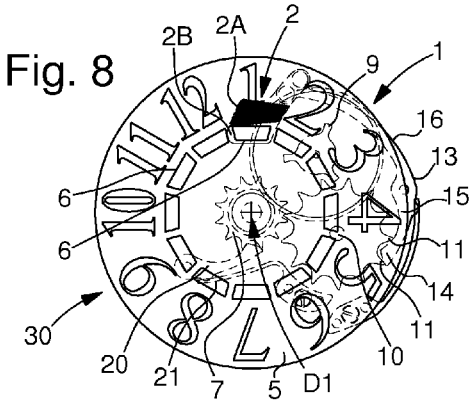
FIG. 8 shows the mechanism in the same position as in FIG. 5, but equipped with an hours disc for the display in the window, this hours disc comprising slots to allow the flag to appear.

FIGS. 1 and 4 illustrate the second stable case of equilibrium, where only the second sector 2B appears in the aperture.

In the embodiment of FIGS. 5 to 8, the lever 13 consists of a single piece, pivots around a pivot axis D4, and is returned to a stable position of equilibrium corresponding to the stoppage of the beak 14 in a tooth space 12 where this beak is supported by two successive teeth 11 of the star wheel 10, by the action of the elastic return means 19 formed by at least one spring.

The lever is moved away from its stable position of equilibrium by the effect of the pivoting movement of the star wheel 10 around a star pivot axis D3 by the action of the driving pinion 9 driven by the drive element 7.

In a second embodiment such as that evident in FIG. 9, the lever 13 is articulated. In a similar manner, a first support arm 15 of the beak 14 is returned to a stable position of equilibrium corresponding to the stoppage of this beak 14 in a tooth space 12 and supported by two successive teeth 11 of the star wheel 10 by the action of the elastic return means 19 formed by at least one spring. The beak 14 forming the jumper 26 collects the information of the imminence of the jump on the driving star wheel 10, and the lever 13, which pivots around an axis 34, is moved away from the stable position of equilibrium by the effect of the pivoting movement of the star wheel 10 by the action of the driving pinion 9 driven by the drive element 7, wherein the pivoting movement of the first arm 15 drives that of a second arm 16 that is integral thereto, and which is itself articulated to a third pivoting support arm 17, which carries the flag 2. Here, the lever 13 and the third arm 17 carrying the indicator blade 18 are in two different planes, and in another variant they can also be set on the same level. In the version illustrated, a stud 31 holds the indicator blade 18 high and limits its stroke. In other embodiments a bridge or plate can perform the same function. The indicator blade 18 pivots around an axis D5, about a stud 32 here, and in a variant that is not shown it can also be stone-set.

Figure 9A:
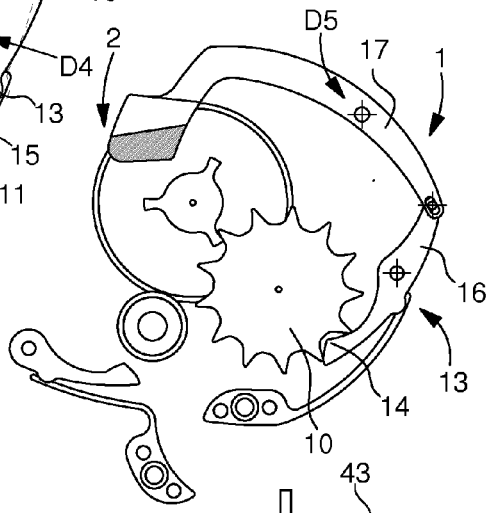
FIG. 9A illustrates another articulated variant.

FIG. 9A illustrates another articulated variant that has been simplified compared to the preceding one.

In an advantageous embodiment, this device 1 is an additional autonomous mechanism comprising a bridge, on which pivots such a driving pinion 9 that is arranged to be driven directly or indirectly by a drive element 7. This bridge is also a carrier of such a lever 13. As above, the driving pinion 9 discontinuously drives a star wheel 10 in order to control a pivoting movement of this star wheel 10 to control each jump of said semi-instantaneous or instantaneous display mechanism 30 against a jumper 26 applied against this star wheel 10 by the elastic return means 19. The jumper 26 is formed by a beak 14 of the lever 13 controlling a pivoting movement and a return to position of the indicator 2 each time the beak 14 passes between two successive tooth spaces 12 that the star wheel 10 comprises by means of a tooth 11 located between these spaces 12. The lever 13 comprises a first support arm 15 of the beak 14 and a second support arm 16 of the indicator 2 or controlling the displacement of the indicator 2.

More generally, the invention relates to a semi-instantaneous or instantaneous jump display mechanism 30 driven by a drive element 7 of a movement 100 or a timepiece 1000 comprising such a change of state indicator device 1, which performs a jump as according to a reciprocating pivoting movement of the indicator 2 for each jump of the semi-instantaneous or instantaneous display mechanism 30.

In the first embodiment the forward pivoting movement of the indicator 2 at least partially displays the first sector 2A indicating a transition in progress at the change of state aperture 3 before the semi-instantaneous or instantaneous display mechanism 30 performs its own jump. The return pivoting movement of the flag 2 displays the second sector 2B indicating a stable state of the display without transition in progress at the change of state aperture 3 in its entirety only after the semi-instantaneous or instantaneous display mechanism 30 has performed and ended its own jump.

In the variant illustrated by the figures, this semi-instantaneous or instantaneous jump display mechanism 30 is a semi-instantaneous or instantaneous jump hours display mechanism 30.

In another variant the semi-instantaneous or instantaneous jump display mechanism 30 is a semi-instantaneous or instantaneous jump days display mechanism 30.

In the case where the semi-instantaneous or instantaneous jump display mechanism 30 incorporates a flag 2 device 1 according to the first embodiment, the forward pivoting movement of the flag 2 at least partially displays the first sector 2A for indicating a transition in progress at the change of state aperture 3 before the semi-instantaneous or instantaneous display mechanism 30 performs its own jump; and the return pivoting movement of the flag 2 displays the second sector 2B for indicating a stable state of the display without transition in progress at the change of state aperture 3 in its entirety only after the semi-instantaneous or instantaneous display mechanism 30 has performed and ended its own jump.

The invention also relates to a timepiece movement 100 comprising such a semi-instantaneous or instantaneous jump display mechanism 30 or comprising a drive element 7 for driving this change of state indicator device 1.

The invention also relates to a timepiece 1000 comprising such a movement 100 or such a semi-instantaneous or instantaneous jump display mechanism 30 or comprising such a change of state indicator device and has a drive element 7 for driving this change of state indicator device 1.

Overall, the invention provides a dependable and economical solution to the posed problem. The small number of necessary components results in an additional mechanism that is easy to insert into an existing calibre. If necessary, the variant with the articulated lever of the second embodiment of FIG. 9 allows congested zones of the movement to be utilised and allows the lever and the flag the be incorporated in the best way so as not to interfere with adjacent components.

The modification of the display disc for the magnitude at which the jump is indicated, in this case the hour or day of the month in the described non-restrictive examples, is limited to the cutting out of additional slots for the flag apertures 6.

In the first embodiment the modification of the main display dial plate is also limited to the cutting out of the flag aperture 3 close to the window 25 forming the aperture for the magnitude at which the jump is indicated.

The insertion of this flag aperture 3 animates the main display and provides reliability of use for the user because the sections of the flag are very easy to interpret.

The mechanism described here may be used to indicate any type of jump.

While the jump of hours or days of the month are preferred applications, different applications are conceivable, e.g. to enable indication of the passage from day to night/night to day in the case where the jump is made instantaneously or semi-instantaneously.

What is claimed is:

1. A mechanical change of state indicator device for a semi-instantaneous or instantaneous display mechanism by jumps of a given magnitude driven by a drive element of a movement or a timepiece, wherein for the display of a transition between two stable display states of said given magnitude said device comprises a change of state display indicator, which is movable in relation to a supplementary change of state display, wherein said device includes elastic return means formed by at least one spring applied against a lever included in said device, and wherein said indicator is driven indirectly and discontinuously by said drive element against elastic return means, wherein said device comprises a driving pinion fitted to be driven directly or indirectly by said drive element, wherein said driving pinion drives a star wheel in a discontinuous manner in order to control a pivoting movement of said star wheel to control each jump of said semi-instantaneous or instantaneous display mechanism against a jumper applied against said star wheel by said elastic return means and said jumper is formed by a beak of said lever, said lever controlling a pivoting movement and a return to position of said indicator each time said beak passes between two successive tooth spaces that said star wheel comprises by means of a tooth located between said spaces, said lever comprising a first support arm and a second support arm, said first support arm supporting said beak, and said second support arm arranged to support said indicator or to control the displacement of said indicator which is formed by a change of state display flag, which is movable in relation to said supplementary change of state display formed by a change of state aperture, and wherein said flag comprises a first sector indicating a transition in progress and a second sector indicating a stable state of the display without transition in progress.

2. The device according to claim 1, wherein, said lever consists of a single piece, pivots around a pivot axis and is returned to a stable position of equilibrium corresponding to the stoppage of said beak in one of said tooth spaces and supported by two of said successive teeth of said star wheel by the action of said elastic return means formed by at least one spring, and wherein said lever is moved away from said stable position of equilibrium by the effect of the pivoting movement of said star wheel around a star pivot axis by the action of said driving pinion driven by said drive element.

3. The device according to claim 1, wherein said lever is articulated and that a first support arm of said beak is returned to a stable position of equilibrium corresponding to the stoppage of said beak in one of said tooth spaces and said beak supported by two successive teeth of said star wheel by the action of said elastic return means, and wherein said lever is moved away from said stable position of equilibrium by the effect of the pivoting movement of said star wheel by the action of said driving pinion driven by said drive element, wherein the pivoting movement of said first arm drives that of a second arm integral thereto, which is itself articulated to a third pivoting support arm of said indicator.

4. The device according to claim 1, wherein said second arm of said lever comprises a rack arranged to pivot a support pinion of said indicator in an interdependent manner.

5. The device according to claim 4, wherein said indicator comprises a hand or a disc movable in relation to said supplementary change of state display formed by guide mark.

6. The device according to claim 1, wherein said device is a change of state indicator for a semi-instantaneous or instantaneous jump hours display mechanism driven by a drive element formed by the cannon pinion of a timepiece movement, and said device comprises a driving pinion mounted to pivot interdependently with a minute wheel engaging with said cannon pinion to discontinuously drive a star wheel in order to control a pivoting movement of said star wheel and a jump of said star wheel by the action of a jumper applied against said star wheel by said elastic return means and activating each jump of the hours of said semi-instantaneous or instantaneous display mechanism.

7. The device according to claim 6, wherein by means of said driving pinion and the star wheel during the jump of the latter, said cannon pinion periodically drives an hour star wheel held by a jumper restored by a spring and drives a hour disc, which has as many flag apertures as there are hours display positions, and each flag aperture comes into superposed position with said supplementary change of state display formed by a change of state aperture to allow the display of said indicator.

8. The device according to claim 1, wherein said device is a change of state indicator for a semi-instantaneous or instantaneous jump display mechanism for days of the month driven by a drive element formed by the cannon pinion of a timepiece movement, and wherein said device comprises a driving pinion mounted to pivot interdependently with a day wheel engaging directly or indirectly with said cannon pinion to discontinuously drive a star wheel in order to control a pivoting movement of said star wheel and a jump of said star wheel by the action of a jumper applied against said star wheel by said elastic return means and activating each jump of the days of said semi-instantaneous or instantaneous display mechanism.

9. The device according to the claim 8, wherein by means of said driving pinion and the star wheel during the jump of the latter, said cannon pinion periodically drives a day star wheel held by a jumper restored by a spring and driving a day disc, which has as many flag apertures as there are days display positions, and each flag aperture comes into superposed position with said supplementary change of state display formed by said change of state aperture to allow the display of said indicator.

10. The device according to the claim 1, wherein said lever controls said flag, which is integral with the end of said second support arm of said lever, to cause said first sector indicating a transition in progress to face said change of state aperture when said beak is supported by a single tooth of said star wheel and to cause said second sector indicating a stable state of the display to face said change of face aperture each time said beak is stopped in one of said tooth spaces and supported by two successive teeth of said star wheel.

11. The device according to claim 1, wherein said device is an additional autonomous mechanism and comprises a bridge supporting said lever and a driving pinion which is arranged to be driven directly or indirectly by said drive element, wherein said driving pinion discontinuously drives a star wheel in order to control a pivoting movement of said star wheel to control each jump of said semi-instantaneous or instantaneous display mechanism against a jumper applied against said star wheel by said elastic return means, and which jumper is formed by a beak of said lever, said lever controlling a pivoting movement and a return to position of said indicator each time said beak passes between two successive tooth spaces that said star wheel comprises by means of a tooth located between said spaces, said lever comprises a first support arm and a second support arm, said first support arm supporting said beak, and said second support arm arranged to support said indicator or to control the displacement of said indicator which is formed by said flag.

12. A semi-instantaneous or instantaneous display mechanism by jumps of a given magnitude driven by a drive element of a movement or a timepiece comprising such a mechanical change of state indicator device according to claim 1, wherein said change of state indicator device performs a jump according to a reciprocating pivoting movement of said indicator for each jump of said semi-instantaneous or instantaneous display mechanism.

13. A semi-instantaneous or instantaneous jump display mechanism according to claim 12, wherein said semi-instantaneous or instantaneous jump hours display mechanism incorporates said mechanical change of state indicator device, wherein said semi-instantaneous or instantaneous jump display mechanism is a change of state indicator for a semi-instantaneous or instantaneous jump hours display mechanism driven by the drive element formed by the cannon pinion of a timepiece movement, and said device comprises a driving pinion mounted to pivot interdependently with a minute wheel engaging with said cannon pinion to discontinuously drive a star wheel in order to control a pivoting movement of said star wheel and a jump of said star wheel by the action of a jumper applied against said star wheel by said elastic return means and activating each jump of the hours of said semi-instantaneous or instantaneous display mechanism, and wherein by means of said driving pinion and the star wheel during the jump of the latter, said cannon pinion periodically drives an hour star wheel held by a jumper restored by a spring and drives a hour disc, which has as many flag apertures as there are hours display positions, and each flag aperture comes into superposed position with said supplementary change of state display formed by a change of state aperture to allow the display of said indicator.

14. A semi-instantaneous or instantaneous jump display mechanism according to claim 13, wherein said semi-instantaneous or instantaneous jump display mechanism is a semi-instantaneous or instantaneous jump days display mechanism and incorporates said mechanical change of state indicator device wherein said semi-instantaneous or instantaneous jump display mechanism a change of state indicator for a semi-instantaneous or instantaneous jump display mechanism for days of the month driven by a drive element formed by the cannon pinion of a timepiece movement, and wherein said device comprises a driving pinion mounted to pivot interdependently with a day wheel engaging directly or indirectly with said cannon pinion to discontinuously drive a star wheel in order to control a pivoting movement of said star wheel and a jump of said star wheel by the action of a jumper applied against said star wheel by said elastic return means and activating each jump of the days of said semi-instantaneous or instantaneous display mechanism, and wherein by means of said driving pinion and the star wheel during the jump of the latter, said cannon pinion periodically drives a day star wheel held by a jumper restored by a spring and driving a day disc, which has as many flag apertures as there are days display positions, and each flag aperture comes into superposed position with said supplementary change of state display formed by said change of state aperture to allow the display of said indicator.

15. A semi-instantaneous or instantaneous jump display mechanism according to claim 12, and comprising said mechanical change of state indicator device, wherein said indicator comprises a change of state display flag, which is movable in relation to said supplementary change of state display formed by a change of state aperture, and wherein said flag comprises a first sector indicating a transition in progress and a second sector indicating a stable state of the display without transition in progress, and wherein the forward pivoting movement of said flag at least partially displays said first sector indicating a transition in progress at the change of state aperture before said semi-instantaneous or instantaneous display mechanism performs its own jump, and wherein the return pivoting movement of said flag displays the second sector indicating a stable state of the display without transition in progress at the change of state aperture in its entirety only after the semi-instantaneous or instantaneous display mechanism has performed and ended its own jump.

16. A timepiece movement comprising a semi-instantaneous or instantaneous display mechanism by jumps of a given magnitude according to claim 12, wherein said timepiece movement comprises said drive element for driving said change of state indicator device.

17. A timepiece comprising a movement according to the claim 16, wherein said timepiece comprises said drive element for driving said change of state indicator device.

18. A timepiece movement comprising a semi-instantaneous or instantaneous display mechanism by jumps of a given magnitude according to claim 12, wherein said timepiece movement comprises said drive element for driving said change of state indicator device.

19. A timepiece movement comprising a change of state indicator device according to claim 1, wherein said timepiece movement comprises said drive element for driving said change of state indicator device.

20. A timepiece comprising a movement according to the claim 19, wherein said timepiece comprises said drive element for driving said change of state indicator device.

21. A timepiece movement comprising a change of state indicator device according to claim 1, wherein said timepiece movement comprises said drive element for driving said change of state indicator device.

* * * * *